US008711180B2

(12) United States Patent
Kim

(10) Patent No.: US 8,711,180 B2
(45) Date of Patent: Apr. 29, 2014

(54) DISPLAY APPARATUS AND CONTROL METHOD THEREOF

(75) Inventor: Jae-cheol Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1204 days.

(21) Appl. No.: 12/127,282

(22) Filed: May 27, 2008

(65) Prior Publication Data

US 2009/0135310 A1 May 28, 2009

(30) Foreign Application Priority Data

Nov. 27, 2007 (KR) ..... 10-2007-0121728

(51) Int. Cl.
*G09G 5/00* (2006.01)

(52) U.S. Cl.
USPC ..... 345/660; 345/1.1; 345/204

(58) Field of Classification Search
USPC ..... 345/1.1, 204, 660
See application file for complete search history.

(56) References Cited

U.S. PATENT DOCUMENTS

| | | | | |
|---|---|---|---|---|
| 6,501,441 | B1 * | 12/2002 | Ludtke et al. | 345/1.1 |
| 7,091,926 | B2 * | 8/2006 | Kulas | 345/1.1 |
| 7,119,849 | B2 * | 10/2006 | Yui et al. | 348/564 |
| 7,250,978 | B2 * | 7/2007 | Lee et al. | 348/383 |
| 7,365,757 | B1 * | 4/2008 | Callway et al. | 345/629 |
| 7,450,176 | B2 * | 11/2008 | Koh | 348/383 |
| 7,463,215 | B2 * | 12/2008 | Love et al. | 345/1.1 |
| 7,495,632 | B2 * | 2/2009 | Love et al. | 345/1.1 |
| 7,505,012 | B2 * | 3/2009 | Love et al. | 345/1.1 |
| 7,626,587 | B1 * | 12/2009 | de Waal et al. | 345/536 |
| 7,629,945 | B2 * | 12/2009 | Baudisch | 345/1.3 |
| 7,675,479 | B2 * | 3/2010 | Jung | 345/1.3 |
| 7,768,576 | B2 * | 8/2010 | Yui et al. | 348/564 |
| 2001/0002124 | A1 * | 5/2001 | Mamiya et al. | 345/132 |
| 2001/0052902 | A1 * | 12/2001 | Ono et al. | 345/502 |
| 2002/0067318 | A1 * | 6/2002 | Matsuzaki et al. | 345/1.1 |
| 2002/0154089 | A1 * | 10/2002 | Yamazaki et al. | 345/103 |

(Continued)

FOREIGN PATENT DOCUMENTS

| | | | |
|---|---|---|---|
| EP | 1107224 | A2 | 6/2001 |
| KR | 1020030056685 | A | 7/2003 |

(Continued)

OTHER PUBLICATIONS

Communication, dated Mar. 14, 2013, issued by the European Patent Office in counterpart European Application No. 08161864.7, 5 pages.

(Continued)

*Primary Examiner* — Viet Pham
(74) *Attorney, Agent, or Firm* — Sughrue Mion, PLLC

(57) ABSTRACT

A display apparatus and a control method of the display apparatus are provided. The display apparatus includes a display panel which is partitioned into a plurality of panel areas, a video dividing unit which divides a video frame into a plurality of video areas, wherein each of the plurality of video areas corresponds to a respective panel area of the plurality of panel areas, a scaler which scales each of the plurality of video areas to fit into a corresponding panel area of the plurality of panel areas, and an operating unit which operates the display panel so that each of the scaled plurality of video areas is displayed in the corresponding panel area of the plurality of panel areas.

22 Claims, 4 Drawing Sheets

(56) References Cited

U.S. PATENT DOCUMENTS

| | | | | |
|---|---|---|---|---|
| 2003/0076278 | A1* | 4/2003 | Choi | 345/1.1 |
| 2004/0169618 | A1* | 9/2004 | Nakai et al. | 345/1.1 |
| 2004/0222943 | A1* | 11/2004 | Kudo et al. | 345/1.1 |
| 2005/0030254 | A1* | 2/2005 | Jung et al. | 345/1.1 |
| 2005/0122347 | A1* | 6/2005 | Buerkle et al. | 345/660 |
| 2005/0151885 | A1* | 7/2005 | Choi | 348/581 |
| 2005/0253799 | A1* | 11/2005 | Kamio | 345/103 |
| 2006/0208993 | A1* | 9/2006 | Jung | 345/98 |
| 2007/0091059 | A1* | 4/2007 | Kang | 345/102 |
| 2007/0109254 | A1* | 5/2007 | Kang | 345/103 |
| 2007/0139297 | A1* | 6/2007 | Kudo et al. | 345/1.1 |
| 2007/0159498 | A1* | 7/2007 | Yang et al. | 345/660 |
| 2007/0171229 | A1* | 7/2007 | Mamiya et al. | 345/503 |
| 2007/0189717 | A1* | 8/2007 | Yun et al. | 386/95 |
| 2007/0210982 | A1* | 9/2007 | Nakai et al. | 345/1.1 |

FOREIGN PATENT DOCUMENTS

| | | | |
|---|---|---|---|
| KR | 1020070045045 | A | 5/2007 |
| KR | 10-2007-0091874 | A | 9/2007 |
| WO | 00/65565 | | 11/2000 |

OTHER PUBLICATIONS

Communication dated Dec. 9, 2013 from the Korean Intellectual Property Office in a counterpart application No. 10-2007-0121728.

* cited by examiner

DISPLAY APPARATUS AND CONTROL METHOD THEREOF

CROSS-REFERENCE TO RELATED APPLICATIONS

This application claims priority from Korean Patent Application No. 10-2007-0121728, filed on Nov. 27, 2007, in the Korean Intellectual Property Office, the disclosure of which is incorporated herein by reference in its entirety.

BACKGROUND OF THE INVENTION

1. Field of the Invention

Apparatuses and methods consistent with the present invention relate to providing a display apparatus and controlling the display apparatus, and more particularly, to providing a display apparatus having a display panel, and processing video to display the processed video on the display panel.

2. Description of the Related Art

Display apparatuses in the related art display data visually. In particular, plasma display panels (PDPs) or liquid crystal displays (LCDs) that are contained in plate type display apparatuses, have excellent image quality among other qualities, such that they are widely employed for televisions (TVs) or monitors. Additionally, development and research of PDPs or LCDs have been continuing in recent years with the aim of producing a new generation of display apparatuses.

As screens of display apparatuses have increased in size, such display apparatuses employ high frequency to convert the resolution of input video into a resolution suitable for being displayed on display apparatuses and to display the converted video on display panels. Alternatively, a problem arises that a frequency higher than the currently used frequency is needed in order to increase the frame rate.

However, it is not easy to operate display apparatuses using high frequency, and furthermore, electromagnetic interference (EMI) may occur even if the video is displayed using high frequency.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a display apparatus and a control method of the display apparatus where high quality video may be provided by dividing the video into a plurality of video areas and displaying the video when a user desires to view the video on the display apparatus.

According to an aspect of the present invention, there is provided a display apparatus which comprises a display panel which is partitioned into a plurality of panel areas; a video dividing unit which divides a video frame into a plurality of video areas so that each of the plurality of video areas corresponds to a respective panel area among the plurality of panel areas; a scaler which scales each of the plurality of video areas into which the video frame is divided; and an operating unit which operates the display panel so that each of the scaled plurality of video areas is displayed on a respective panel area among the plurality of panel areas.

The display panel may be partitioned vertically or horizontally.

The scaler may comprise sub-scalers, the number of which is equal to the number of video areas into which the video frame is divided.

The operating unit may comprise a data operating unit which supplies a data signal to a data line of the display panel, the data operating unit being disposed on a first edge of the display panel; and a gate operating unit which supplies a scan signal to a gate line of the display panel, the data operating unit being disposed on a second edge of the display panel. The first edge and the second edge may be adjacent to each other.

A single data operating unit and a single gate operating unit may be provided.

The operating unit may display the scaled plurality of video areas on the display panel using the same synchronizing signal.

According to an aspect of the present invention, there is provided a control method of a display apparatus, which displays video on a display panel, the control method which comprises dividing a video frame into a plurality of video areas; scaling each of the plurality of video areas into which the video frame is divided; and displaying the scaled plurality of video areas on the display panel. The display panel may be partitioned into a plurality of panel areas, and each of the plurality of video areas into which the video frame is divided may correspond to a respective panel area among the plurality of panel areas.

The display panel may be partitioned vertically or horizontally.

The scaling may comprise individually scaling each of the plurality of video areas into which the video frame is divided.

The displaying may comprise displaying the scaled plurality of video areas using the same synchronizing signal.

The displaying may further comprise sequentially and simultaneously displaying each of the scaled plurality of video areas.

According to another aspect of the present invention, there is provided a display apparatus which comprises a scaler which scales a video frame; a display panel which is partitioned into a plurality of panel areas; and an operating unit which operates the display panel to display the scaled video frame. The video frame may comprise a plurality of video areas, and each of the plurality of video areas may correspond to a respective panel area among the plurality of panel areas.

The display panel may be partitioned vertically or horizontally.

The operating unit may cause the display panel to display the plurality of video areas using the same synchronizing signal.

The number of wires to connect the scaler to the operating unit may be equal to or a multiple of the number of video areas.

According to another aspect of the present invention, there is provided a control method of a display apparatus, the control method which comprises scaling a video frame; and displaying the scaled video frame on a display panel partitioned into a plurality of panel areas. The video frame may comprise a plurality of video areas, and each of the plurality of video areas may correspond to a respective panel area among the plurality of panel areas.

The display panel may be partitioned vertically or horizontally.

The displaying may comprise displaying the plurality of video areas on the display panel using the same synchronizing signal.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
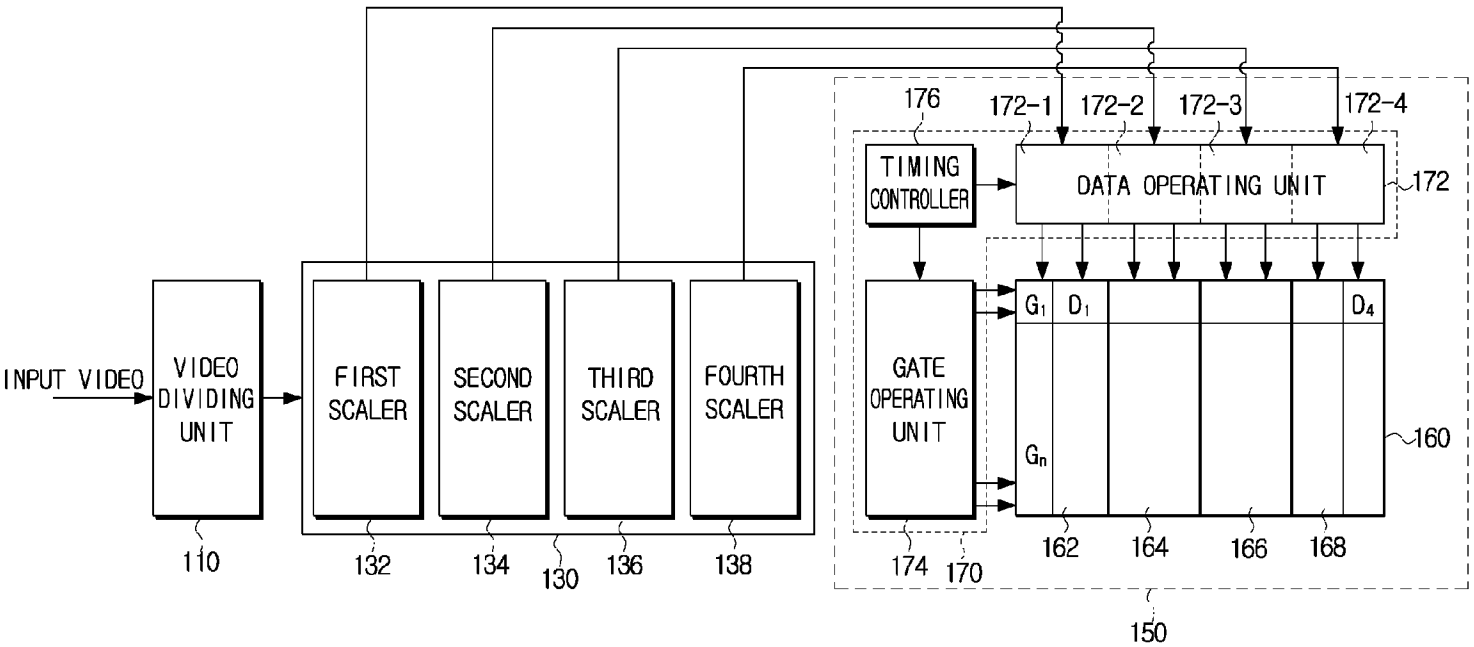
FIG. 1 is a block diagram of a display apparatus according to an exemplary embodiment of the present invention.

The present invention will now be described more fully with reference to the accompanying drawings, in which exemplary embodiments of the present invention are shown In the following description, same drawing reference numerals are used for the same elements even in different drawings. The matters defined in the description, such as detailed construction and elements, are provided to assist in a comprehensive understanding of the invention. Thus, it is apparent that the exemplary embodiments of the present invention can be carried out without those specifically defined matters. Also, well-known functions or constructions are not described in detail since they would obscure the invention with unnecessary detail.

FIG. 1 is a block diagram of a display apparatus according to an exemplary embodiment of the present invention. The display apparatus of FIG. 1 comprises a video dividing unit 110, a scaler 130 and a display unit 150.

The video dividing unit 110 divides input video into a plurality of video areas. The video input to the video dividing unit 110 may be frame-based. Additionally, the video dividing unit 110 may divide the frame-based video into a plurality of video areas which may be individually displayed on a plurality of panel areas of the display panel 160.

The display panel 160 may be horizontally partitioned into four equal panel areas. Accordingly, the video dividing unit 110 may divide the frame-based video into four equal video areas, namely first to fourth video areas.

The scaler 130 adjusts the size of the input video so that the input video fits onto a screen to be displayed, and converts the resolution of the input video into a resolution identical to that of the display apparatus.

In this exemplary embodiment of the present invention, the scaler 130 may comprise four sub-scalers, namely a first scaler 132, second scaler 134, third scaler 136 and fourth scaler 138, in order to convert the resolution of the four video areas. The first to fourth scalers 132 to 138 may scale the first to fourth video areas, respectively. Additionally, the video output from the scaler 130 may be of low voltage differential signal (LVDS) format.

The four video areas scaled by the first to fourth scalers 132 to 138 may be transferred to the display unit 150 in single- or dual-LVDS format. Accordingly, four or eight wires are needed in single- or dual-LVDS formats respectively to connect the scaler 130 to the display unit 150.

The display unit 150 displays video, and comprises the display panel 160 and an operating unit 170.

The display panel 160 is a device on which video is displayed. In the display panel 160, 4m×n pixels are arranged in matrix form, and 4m data lines, namely D1 to D4m, and n gate lines, namely G1 to Gn, cross. A thin film transistor (TFT) is disposed on a portion in which the data lines and gate lines cross.

The display panel 160 may be partitioned into a plurality of panel areas. In this exemplary embodiment of the present invention, the display panel 160 is horizontally partitioned into four equal panel areas, namely a first panel area 162, second panel area 164, third panel area 166 and fourth panel area 168.

Each of the plurality of panel areas includes m×n pixels arranged in matrix form, wherein m data lines, namely D1 to Dm, and n gate lines, namely G1 to Gn, cross, and a TFT is disposed on a portion in which the data lines and gate lines cross.

The TFT included in the display panel 160 performs a switching operation in response to scan signals supplied from the gate lines and data signals supplied from the data lines.

The first panel area 162 is represented by the first pixel to m-th pixel horizontally, the second panel area 164 is represented by the m+1-th pixel to 2m-th pixel horizontally, the third panel area 166 is represented by the 2m+1-th pixel to 3m-th pixel horizontally, and the fourth panel area 168 is represented by the 3m+1-th pixel to 4m-th pixel horizontally.

The first to fourth video areas are displayed on the first to fourth panel areas 162, 164, 166 and 168, respectively.

The operating unit 170 comprises a data operating unit 172 which supplies data signals to the data lines, a gate operating unit 174 which supplies scan signals to the gate lines, and a timing controller 176 which controls the data operating unit 172 and gate operating unit 174 using synchronizing signals.

The data operating unit 172 may be disposed on the top or bottom of the display panel 160, and the gate operating unit 174 may be disposed on the left or right side of the display panel 160.

The timing controller 176 generates a first control signal to control the data operating unit 172 using a vertical synchronizing signal, and a second control signal to control the gate operating unit 174 using a horizontal synchronizing signal.

The data operating unit 172 converts digital video transferred from the scaler 130 into analog data signals and supplies the analog data signals to the data lines, in response to the first control signal from the timing controller 176.

The gate operating unit 174 sequentially supplies scan pulse signals to the gate lines and selects horizontal lines of the display panel 160 to which the data signals are supplied, in response to the second control signal from the timing controller 176.

The data operating unit 172 may be a single device or may be divided into a first data operating unit 172-1, second data operating unit 172-2, third data operating unit 172-3 and fourth data operating unit 172-4, to which the first to fourth video areas are respectively transferred.

In more detail, each of the first to fourth data operating units 172-1 to 172-4 may receive the respective first to fourth video areas scaled by the first to fourth scalers 132 to 138, via one or two wires.

However, the first to fourth data operating units 172-1 to 172-4 may supply data signals to the display panel 160 sequentially and simultaneously using the same vertical synchronizing signal, rather than using individual vertical synchronizing signals.

Accordingly, the first to fourth data operating units 172-1 to 172-4 may be combined in a single device physically and electrically. Also, the gate operating unit 174 may be a single device physically and electrically.

Figure 2:
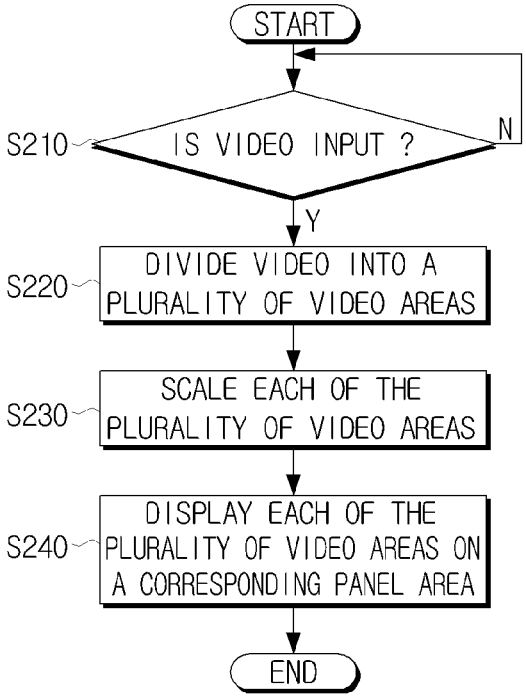
FIG. 2 is a flowchart explaining a method for dividing video into a plurality of video areas and displaying the plurality of video areas on different panel areas, according to an exemplary embodiment of the present invention.

Hereinafter, a method by which the display apparatus of FIG. 1 divides video into a plurality of video areas and displays the plurality of video areas will be described in detail with reference to FIG. 2. FIG. 2 is a flowchart explaining a method for dividing video into a plurality of video areas and displaying the plurality of video areas on different panel areas, according to an exemplary embodiment of the present invention.

In FIG. 2, if video is input (operation S210-Y), the video dividing unit 110 may divide the input video into four video areas (operation S220). Here, the input video may be frame-based. The video dividing unit 110 may divide the frame-based video horizontally into quarters to obtain the first to fourth video areas. The four video areas may be output to the scaler 130.

The scaler 130 may scale each of the video areas (operation S230). Since the scaler 130 comprises the sub-scalers, namely the first to fourth scalers 132, 134, 136 and 138, the sub-scalers may scale the first to fourth video areas, respectively. The scaled video areas may be output to the display unit 150 in single- or dual-LVDS format.

The display unit 150 may display each of the plurality of video areas on a corresponding panel area (operation S240). In more detail, the first to fourth video areas may be transferred to the first to fourth data operating units 172-1 to 172-4, respectively. The first to fourth data operating units 172-1 to 172-4 may sequentially supply the data signals to the first to fourth panel areas 162 to 168, respectively, in response to the same vertical synchronizing signal, so that the video may be displayed on the display panel 160.

As described above, when the display apparatus displays video on a display panel having a large screen, the video may be divided into a plurality of video areas, and each of the video areas may be individually scaled, so that each of the scaled video areas may appear on the corresponding panel area. Therefore, a high frequency is not required.

Additionally, the display panel 160 is partitioned horizontally or vertically, and each of the video areas is displayed simultaneously using the same synchronizing signal, so only a single data operating unit 172 and a single gate operating unit 174 which supplies data signals and scan signals to the display panel 160 may be required.

Therefore, the productivity of the display apparatus may increase, and cost competitiveness may thus also increase. Additionally, the scaler 130 and the display panel 160 each comprises a plurality of units, so if a problem arises in the display apparatus, it is possible to easily check the problem. Thus, designing the scaler may also be made easier.

Figure 3:
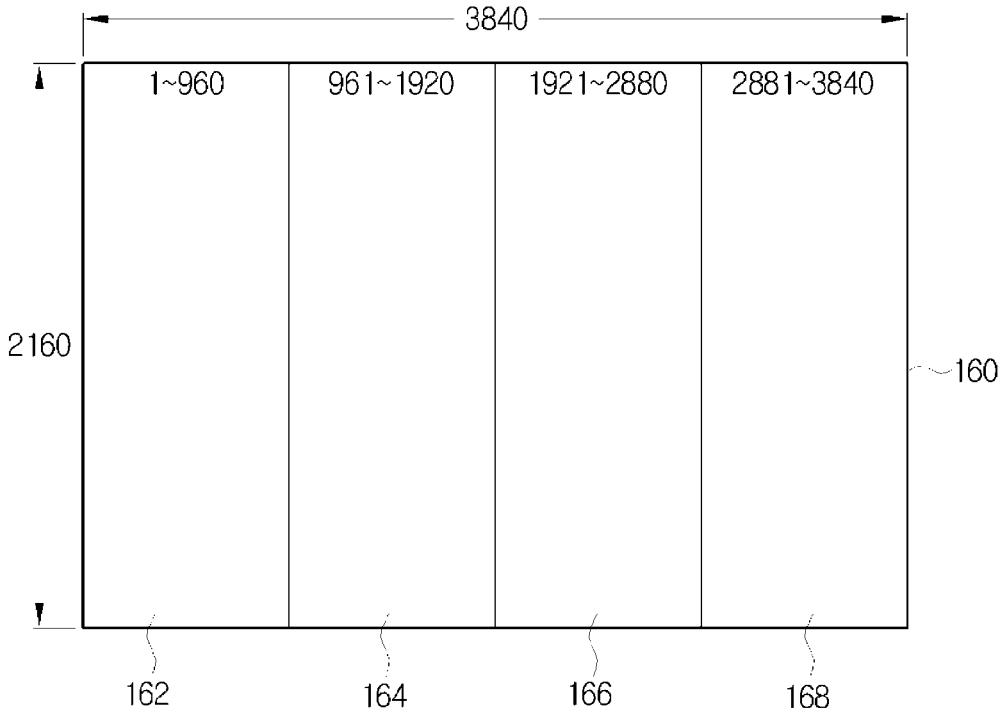
FIG. 3 is a diagram showing a display panel having 3840×2160 pixels, which is divided into quarters horizontally, according to an exemplary embodiment of the present invention.

FIG. 3 is a diagram showing a display panel 160 having 3840×2160 pixels, which is divided into quarters vertically, according to an exemplary embodiment of the present invention. In FIG. 3, each of the panel areas has 960×2160 pixels. The first pixel to 960-th pixel horizontally represent the first panel area 162, the 961-th pixel to the 1920-th pixel horizontally represent the second panel area 164, the 1921-th pixel to the 2880-th pixel horizontally represent the third panel area 166, and the 2881-th pixel to 3840-th pixel horizontally represent the fourth panel area 168.

Figure 4:
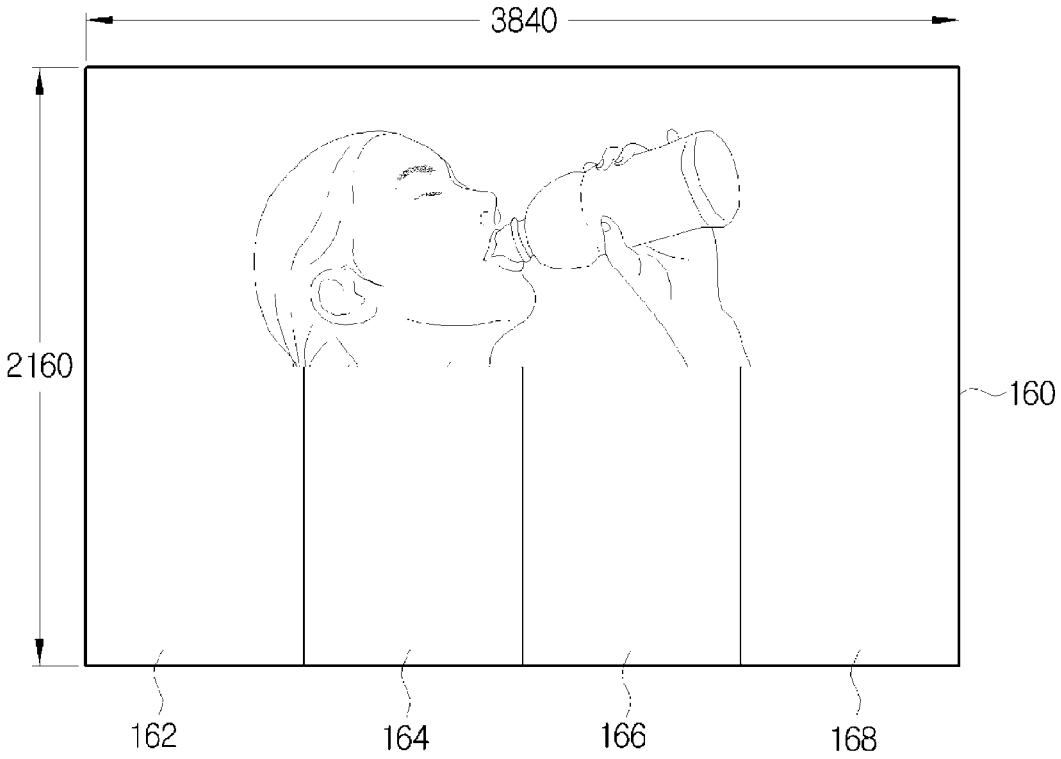
FIG. 4 is a diagram showing a situation in which a video frame is partially displayed on a display panel having 3840×2160 pixels, according to an exemplary embodiment of the present invention.

FIG. 4 shows a situation in which the video frame is partially displayed on the display panel 160 having 3840×2160 pixels, according to an exemplary embodiment of the present invention. In FIG. 4, even when the display panel 160 is partitioned into the plurality of panel areas, the same synchronizing signal is used, so it is possible to easily display the video frame.

Although the video frame is divided vertically in the exemplary embodiment of the present invention, the video frame may be divided horizontally. If the video frame is divided horizontally, the data operating unit 172 of the display unit 150 may be disposed on the left or right side of the display panel 160, and the gate operating unit 174 of the display unit 150 may be disposed on the top or bottom of the display panel 160.

Additionally, the video frame is divided into four video areas in the exemplary embodiment of the present invention, but the present invention is not limited to a certain number of video areas. Accordingly, the video frame may be divided into any number of video areas of the same size, or video areas having different sizes.

Furthermore, the scaler 130 includes a plurality of sub-scalers to scale the video areas in the exemplary embodiment of the present invention. However, it is also possible for a single scaler 130 to scale the video frame, divide the scaled video frame into a plurality of video areas and transfer each of the plurality of video areas to a corresponding panel area. In this situation, the number of wires to connect the scaler 130 to the display panel 160 and transmit video may be equal to or a multiple of the number of divided video areas.

As described above, according to the exemplary embodiment of the present invention, if video is divided into a plurality of video areas and if the plurality of video areas are displayed, it is possible to prevent the frame rate from being reduced even using a large scale display panel, and to display the video using a low frequency.

Furthermore, since the video may be divided vertically or horizontally, an extra operating unit is not required. Additionally, an original operating unit is used without additional operating units, so productivity may increase and costs for producing the display apparatus may be reduced.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A display apparatus comprising:

a display unit including a single display panel, which is partitioned into a plurality of panel areas, and an operating unit which operates the single display panel;

a video dividing unit which divides a single video frame into a plurality of video areas, wherein each of the plurality of video areas corresponds to a respective panel area of the plurality of panel areas; and a scaler comprising a plurality of sub-scalers which individually scale each of the plurality of video areas to fit into a corresponding panel area of the plurality of panel areas, wherein the plurality of sub-scalers are respectively connected to each input of the operating unit by using lines of the same number as the plurality of panel areas, and wherein the operating unit operates the single display panel so that each of the scaled plurality of video areas is displayed in the corresponding panel area of the plurality of panel areas.

2. The display apparatus of claim 1, wherein the single display panel is partitioned vertically or horizontally.

3. The display apparatus of claim 1, wherein the scaler comprises sub-scalers, and a number of the sub-scalers is equal to a number of the plurality of video areas.

4. The display apparatus of claim 1, wherein the operating unit comprises:

a data operating unit which supplies a data signal to a data line of the single display panel, and is disposed on a first edge of the single display panel; and a gate operating unit which supplies a scan signal to a gate line of the single display panel, and is disposed on a second edge of the single display panel, wherein the first edge of the single display panel and the second edge of the single display panel are adjacent to each other.

5. The display apparatus of claim 4, wherein the data operating unit is a single data operating unit, and the gate operating unit is a single gate operating unit.

6. The display apparatus of claim 1, wherein the operating unit displays the scaled plurality of video areas on the single display panel using a same synchronizing signal.

7. A control method of a display apparatus, which has a single display panel and an operating unit that operates the single display panel, and which displays video on the single display panel partitioned into a plurality of panel areas, the control method comprising:

dividing a single video frame into a plurality of video areas, wherein each of the plurality of video areas corresponds to a respective panel area of the plurality of panel areas;

scaling each of the plurality of video areas to fit into a corresponding panel area of the plurality of panel areas; and displaying the scaled plurality of video areas on the single display panel so that each of the scaled plurality of video areas are displayed in the corresponding panel area of the plurality of panel areas, wherein each area of the video frame is individually scaled by a plurality of sub-scalers to fit into the corresponding panel area of the plurality of panel areas respectively, and wherein the scaled video frame is provided to a respective input of an operating unit connected to each of the sub-scalers by using lines of the same number as the plurality of panel areas.

8. The control method of claim 7, wherein the single display panel is partitioned vertically or horizontally.

9. The control method of claim 7, wherein the scaling comprises individually scaling each of the plurality of video areas to fit into the corresponding panel area of the plurality of panel areas.

10. The control method of claim 7, wherein the displaying comprises displaying the scaled plurality of video areas using a same synchronizing signal.

11. The control method of claim 7, wherein the displaying further comprises sequentially and simultaneously displaying each of the scaled plurality of video areas.

12. A display apparatus comprising:

a scaler which scales a single video frame;

a single display panel which is partitioned into a plurality of panel areas; and an operating unit which operates the single display panel to display the scaled video frame, wherein the single video frame comprises a plurality of video areas, and each of the plurality of video areas corresponds to a respective panel area among the plurality of panel areas, wherein the scaler comprises a plurality of sub-scalers which individually scale each of the plurality of video areas to fit into the corresponding panel area of the plurality of panel areas respectively, and wherein the sub-scalers are connected to each input of the operating unit by using lines of the same number as the plurality of panel areas in order to provide an scaled video frame.

13. The display apparatus of claim 12, wherein the single display panel is partitioned vertically or horizontally.

14. The display apparatus of claim 12, wherein the operating unit operates the single display panel to display the plurality of video areas using a same synchronizing signal.

15. The display apparatus of claim 12, wherein a number of wires to connect the scaler to the operating unit is equal to a number of the plurality of video areas or equal to a multiple of the number of the plurality of video areas.

16. A control method of a display apparatus, the control method comprising:

scaling a single video frame; and displaying the scaled video frame on a single display panel partitioned into a plurality of panel areas, wherein the single video frame comprises a plurality of video areas, and each of the plurality of video areas corresponds to a respective panel area among the plurality of panel areas, wherein each of the plurality of video areas is individually scaled by a plurality of sub-scalers to fit into the corresponding panel area of the plurality of panel areas respectively, and wherein the scaled video frame is provided to a respective input of an operating unit connected to each of the sub-scalers by using lines of the same number as the plurality of panel areas.

17. The control method of claim 16, wherein the single display panel is partitioned vertically or horizontally.

18. The control method of claim 16, wherein the displaying comprises displaying the plurality of video areas on the single display panel using a same synchronizing signal.

19. The display apparatus of claim 1, wherein the display unit further includes:

a data operating unit, which is disposed on a first portion of the single display panel, and which supplies data signals to a plurality of data lines of the single display panel; and a gate operating unit, which is disposed on a second portion of the single display panel, and which supplies scan signals to a plurality of gate lines of the single display panel, and wherein the single display panel of the display unit further includes:

a plurality of pixels arranged in matrix form, wherein each of the plurality of panel areas corresponds to a respective area of pixels among the plurality of pixels in the display panel; and a thin film transistor (TFT), which is disposed on a portion of the single display panel in which the plurality of data lines and the plurality of gate lines cross, and which performs a switching operation in response to the scan signals supplied from the gate lines and the data signals supplied from the data lines.

20. The display apparatus of claim 19, wherein the scaler comprises a plurality of sub-scalers, and a number of the plurality of sub-scalers is equal to a number of the plurality of video areas, and each of the of sub-scalers is connected to a respective input of the operating unit included in the display unit, and wherein each of the sub-scalers respectively scales each of the plurality of video areas to fit into the corresponding panel area of the plurality of panel areas.

21. The display apparatus of claim 1, wherein the single display panel is partitioned into plural panel areas, and the plural panel areas disposed in a common housing of the single display.

22. The display apparatus of claim 21, wherein the video dividing unit provides the plurality of video areas to the single display panel having the partitioned plural panel areas.

* * * * *